US006899564B2

(12) United States Patent
Lee

(10) Patent No.: US 6,899,564 B2
(45) Date of Patent: May 31, 2005

(54) REINFORCED SERIAL ATA CONNECTOR

(75) Inventor: George Lee, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/677,061

(22) Filed: Sep. 30, 2003

(65) Prior Publication Data

US 2005/0070159 A1 Mar. 31, 2005

(51) Int. Cl.[7] ..... H01R 13/58
(52) U.S. Cl. ..... 439/606; 439/378; 439/354
(58) Field of Search ..... 439/378, 374, 439/606, 736, 79, 660, 354, 357, 358, 680, 439/681, 682

(56) References Cited

U.S. PATENT DOCUMENTS 5,356,300 A 10/1994 Costello et al.
5,389,006 A * 2/1995 Noschese ..... 439/354
5,830,001 A * 11/1998 Kinoshita et al. ..... 439/354
6,200,171 B1 * 3/2001 Fusselman et al. ..... 439/736
6,315,606 B1 * 11/2001 Hwang ..... 439/557
6,402,552 B1 * 6/2002 Wagner ..... 439/606
6,592,401 B1 7/2003 Gardner et al.

OTHER PUBLICATIONS www.westerndigital.com/en/company/branding/digital photos.asp.
www.westerndigital.com/en/library/eide/2579-001075-001.pdf.

* cited by examiner

*Primary Examiner*—Alex Gilman
(74) *Attorney, Agent, or Firm*—Wei Te Chung

(57) ABSTRACT

A Serial ATA connector (1) includes an insulative housing (10) consisting of a first housing member (11) and a second housing member (12), and a plurality of terminals (140, 141) received in the housing. The first housing member defines a plurality of depressed molding areas (116, 117, 118, 119) for being filled with injected molding materials to form the second housing member. A pair of reinforcing posts (115) is provided on the first housing member to further increase the strength of the housing.

10 Claims, 7 Drawing Sheets

REINFORCED SERIAL ATA CONNECTOR

BACKGROUND OF THE INVENTION

1. Field of the Invention

The present invention relates to an electrical connector, and particularly to a Serial ATA (Advanced Technology Attachment) connector having increased strength.

2. Description of Related Art

It is expected that Serial ATA, which is featured in lower voltage and lower pin count, will eventually completely replace today's parallel ATA. According to the Serial ATA standard, a Serial ATA device, generally disk drives and storage peripherals, may be connected to a host through a cable. For connection via cable, a device plug connector mates with a cable receptacle connector at one end of the cable. A second cable receptacle connector at the other end of the cable is adapted for mating with a host plug connector, so that an electrical connection is established between the Serial ATA device and the host. The standard Serial ATA device plug connector comprises two L-shaped blades with respective signal/ground and power/ground contacts disposed thereon for being inserted into corresponding L-shaped receiving slots of a standard Serial ATA cable receptacle connector. Signal/ground and power/ground contacts are also respectively disposed on one side of the receiving slots.

The standard Serial ATA connector demonstrates acceptable performance when engaged with a backplane of the host or a mating connector. However, the standard Serial ATA connector, which is relatively tiny in configuration, has severe limitations in cabled environments and is prone to breakage. The provision of the receiving slots of the cable receptacle connector and the thin blades of the device plug connector as well as the spaces thereabout significantly decreases the strength of the respective housings. As a result, a stress is apt to be applied at the time of connection and the housing is susceptible to breakage at the time of connection and disconnection. Particularly, the blade of the device plug connector is easy to break in the event that the cable is deflected in such a way as to act as a lever arm concentrating forces on the blade of the plug connector. Also, a rough pull of the cable may result in breakage of upper and lower slot walls of the cable receptacle connector since they are fairly thin.

Currently, strength requirements are becoming more stringent. One possible solution to meet with this requirement is to use a very high strength engineering plastic, especially one that is filled with glass fibers. However, the strength and rigidity still may not be high enough to avoid breakage in normal use where a pull on the cable of more than four pounds in different directions may be applied. Also, glass fiber reinforced plastics have strengths and rigidities that are not highly consistent. Furthermore, this solution causes another unexpected inconvenience, that is, the cable extending from the connector housing becomes liable to be bent in an acute angle at its junction with the connector housing due to an abrupt change of the stiffness at that location. This bending may cause breakage of the cable conductors.

Accordingly, a Serial ATA connector which overcomes the breakage problem presented in the prior art is desired.

SUMMARY OF THE INVENTION

Accordingly, the object of the present invention is to provide a Serial ATA connector having increased physical strength to resist breakage thereof while remaining compatible with standard Serial ATA cables and backplanes.

In order to achieve the object set forth, a Serial ATA connector in accordance with the present invention comprises an insulative housing consisting of first and second housing members, and a plurality of terminals received in the housing. The first housing member defines a plurality of depressed molding areas for being filled with injected molding materials to form the second housing member. A pair of reinforcing posts is provided on the first housing member to further increase the strength of the housing.

Other objects, advantages and novel features of the invention will become more apparent from the following detailed description when taken in conjunction with the accompanying drawings.

DETAILED DESCRIPTION OF THE INVENTION

Figure 1:
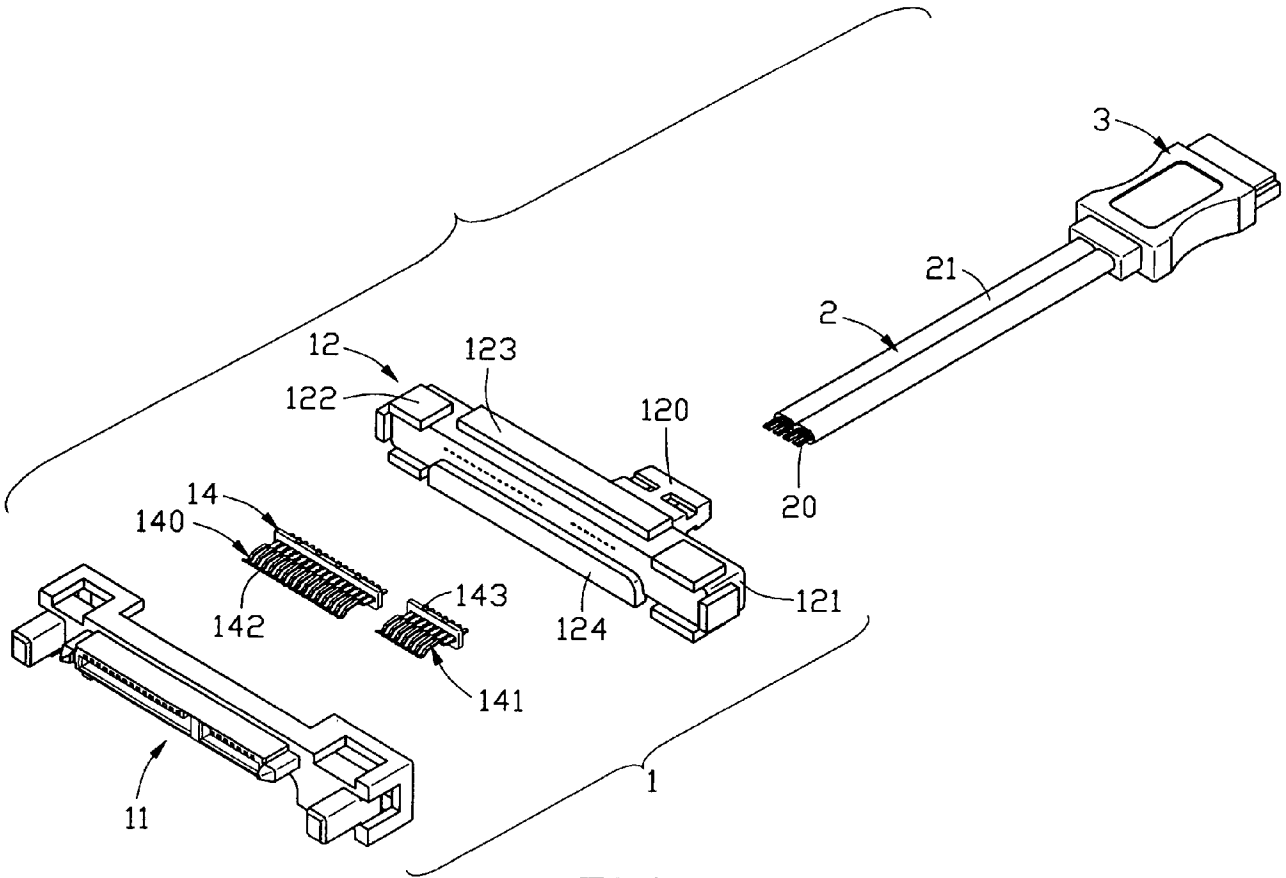
FIG. 1 is an exploded, perspective view of a Serial ATA connector in accordance with the present invention and a Serial ATA cable plug assembly to be connected thereto.

Reference will now be made to the drawing figures to describe the present invention in detail.

Figure 2:
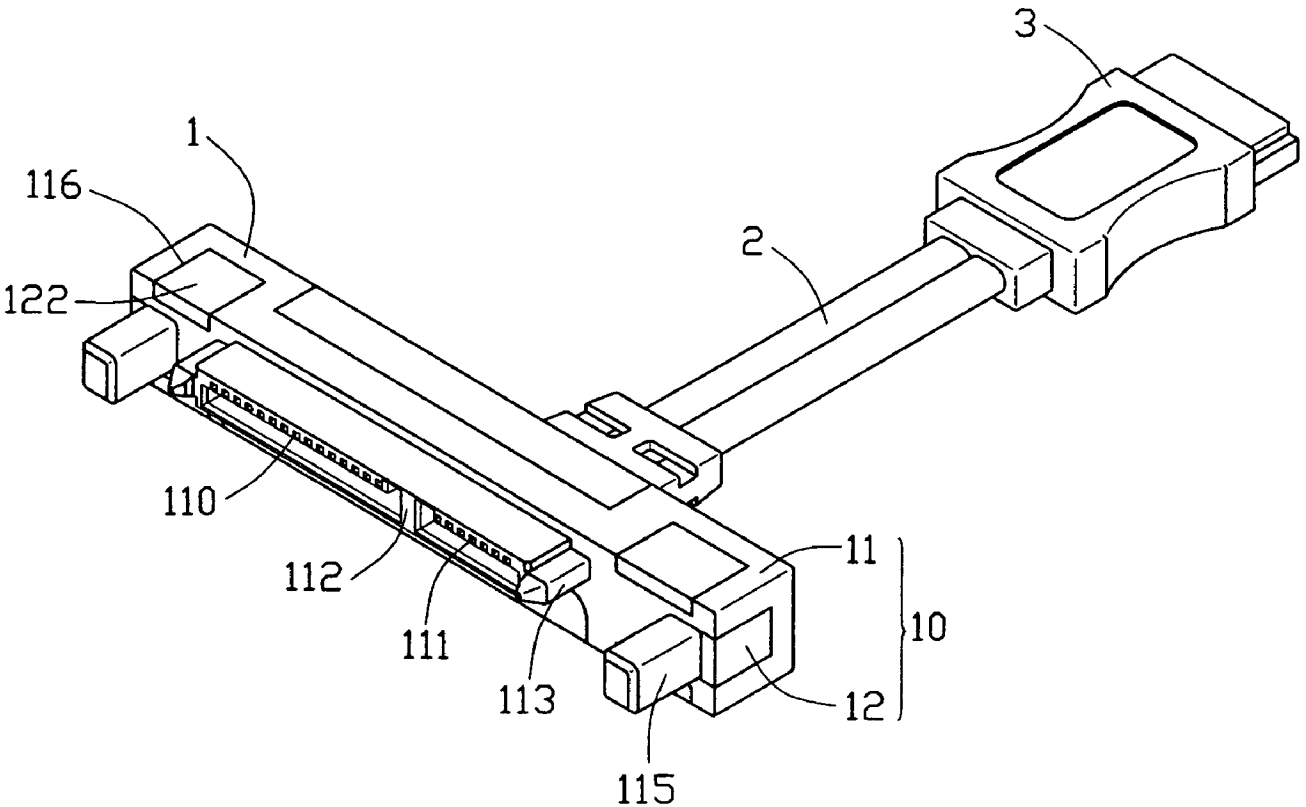
FIG. 2 is an assembled view of FIG. 1.
Figure 3:
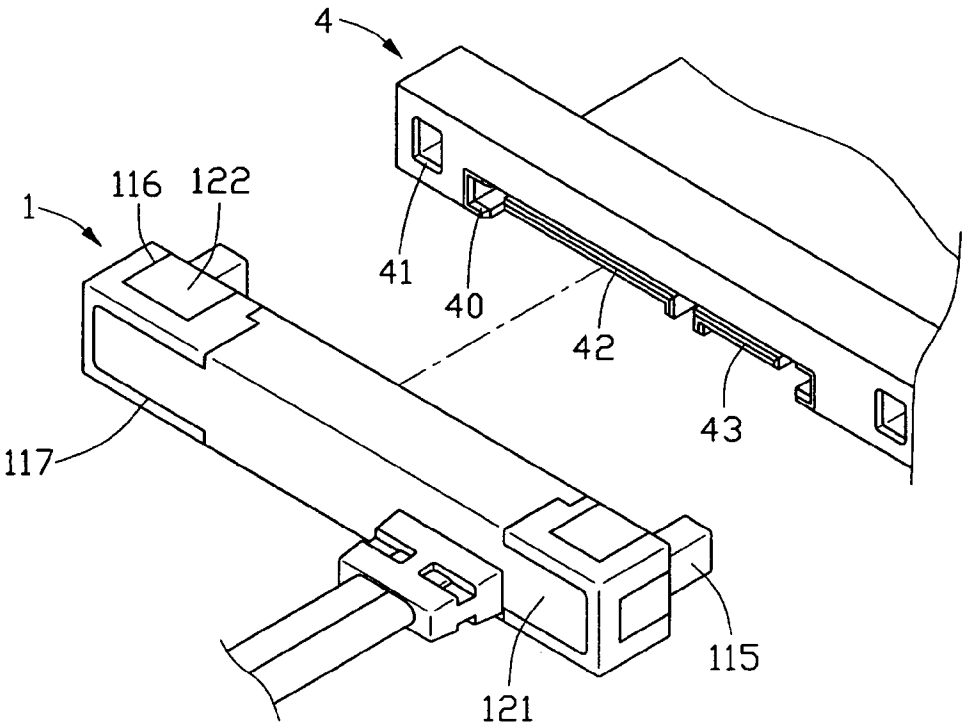
FIG. 3 is a perspective view of the Serial ATA connector in accordance with the present invention to be mated with a Serial ATA device plug connector.

Referring to FIGS. 1–3, a Serial ATA connector in accordance with the present invention, which is a Serial ATA cable receptacle connector 1 as applied in this embodiment, is adapted for mating with a Serial ATA plug connector 4 on a storage device such as a hard drive at one end thereof. The other end of the Serial ATA cable receptacle connector 1 is adapted for connecting with a Serial ATA cable plug assembly consisting of a Serial ATA cable 2 and a Serial ATA cable plug connector 3. The Serial ATA cable 2 consists of eight conductors 20 in four differential pairs. Opposite ends of the conductors 20 are terminated to corresponding terminals of the receptacle connector 1 and the plug connector 3. The Serial ATA cable plug connector 3 is adapted to mate with a complementary Serial ATA receptacle connector on a host printed circuit board (PCB) (not shown), so that an electrical connection between the storage device and the host PCB is established.

The Serial ATA cable receptacle connector 1 comprises an elongate insulative housing 10 and two terminal modules 14 to be assembled to the housing 10. As shown, the housing 10 is composed of a first housing member 11 and a second housing member 12. First and second passageways 110, 111 are defined through the first housing member 11. The terminal modules 14 have two sets of terminals 140, 141 corresponding to the first and second passageways 110, 111. According to the Serial ATA standard, the two sets of terminals 140, 141 are designated as power/ground terminals and signal/ground terminals, respectively. The first and second passageways 110, 111 are separated from each other by a partitioner 112. The partitioner 112 may be integrally formed with the first housing member 11 or as a separate component which is suitably attached to the first housing member 11. Alternatively, the partitioner 112 could be replaced by a conductive shielding member in the event additional electrical separation is desired. A pair of mating posts 113 is provided on opposite sides of the first and second passageways 110, 111 for insertion into corresponding receiving channels 40 of the device plug connector 4.

Figure 4:
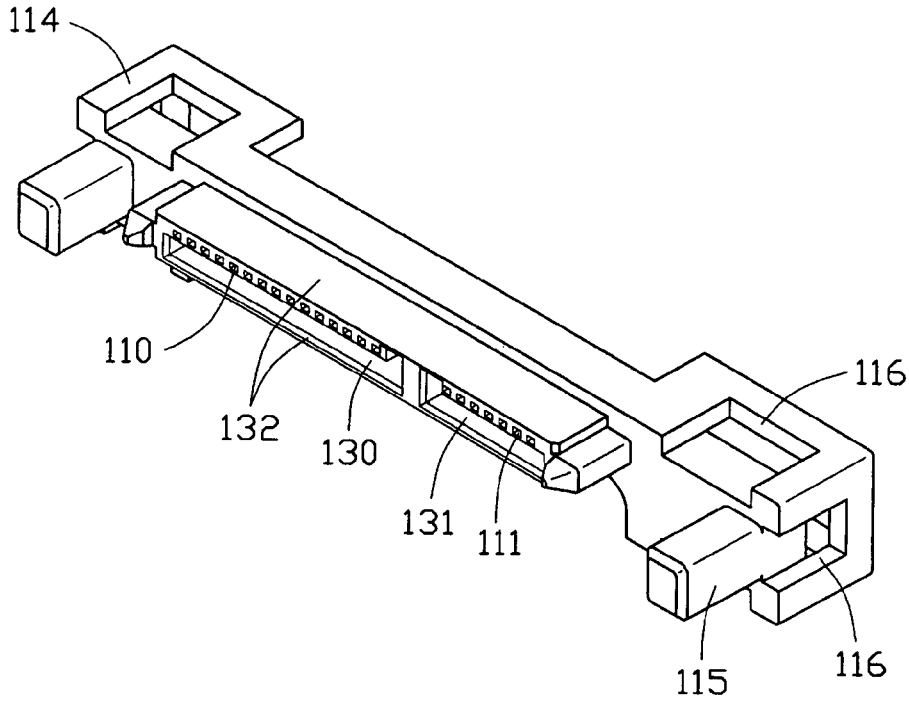
FIG. 4 is a perspective view of a first housing member of the Serial ATA connector shown in FIG. 1, viewed from front and upper aspects.
Figure 5:
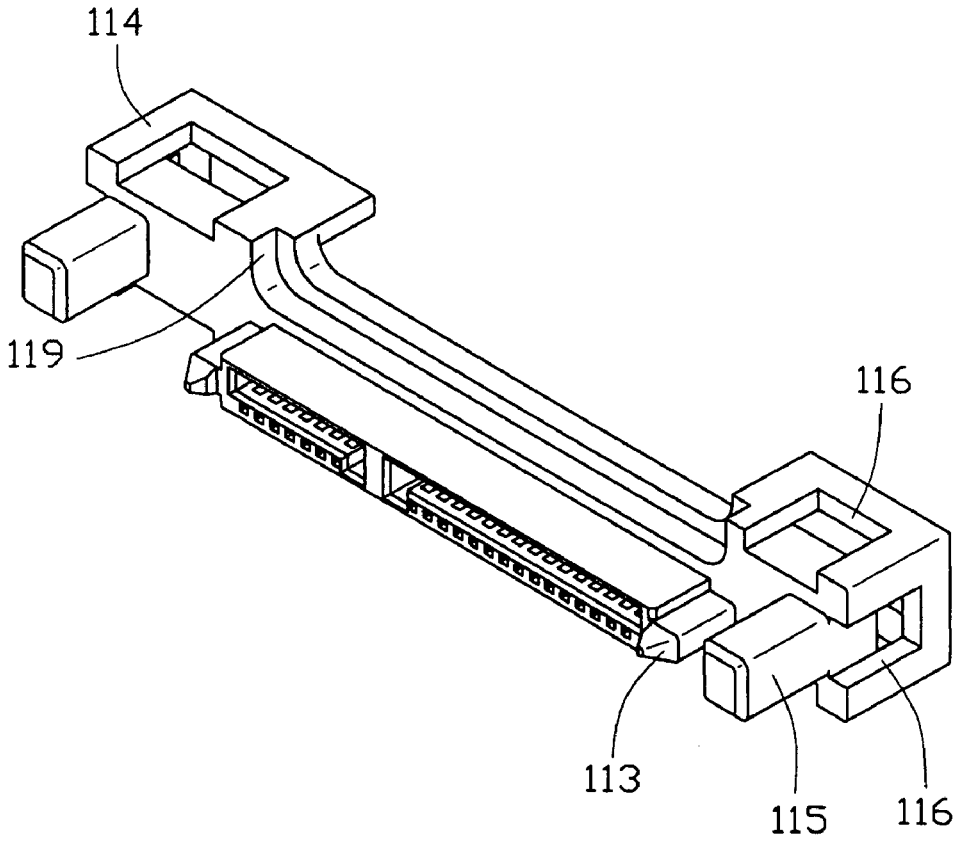
FIG. 5 is a perspective view of the first housing member viewed from front and lower aspects.
Figure 6:
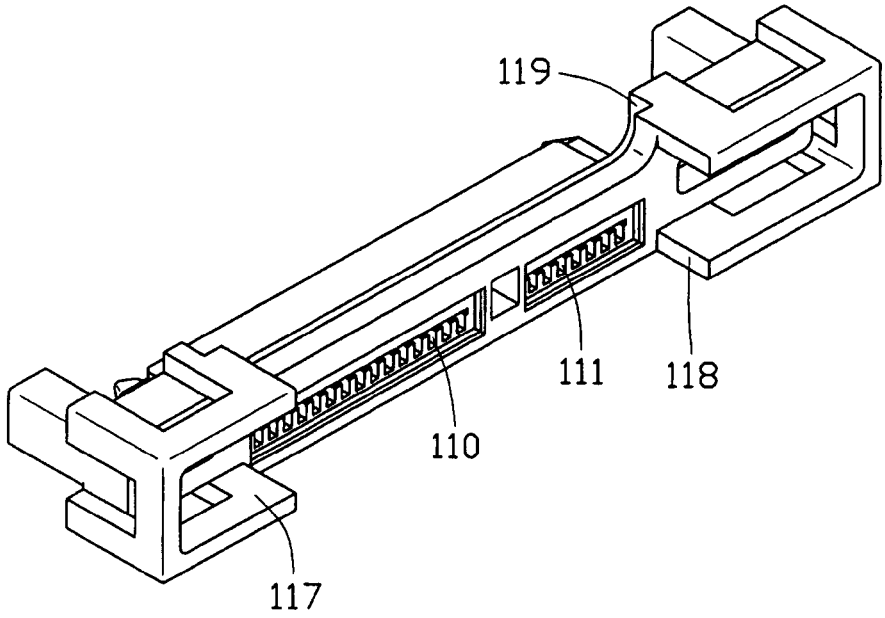
FIG. 6 is a perspective view of the first housing member viewed from rear and lower aspects.

As shown in FIGS. 4–6, the first housing member 11 has opposite side portions 114 providing a pair of respective reinforcing posts 115 for insertion into corresponding receiving holes 41 of the device plug connector 4 (FIG. 3). Front ends of the reinforcing posts 115 are tapered to facilitate insertion. A plurality of depressed molding areas is defined in the first housing member 11 which includes, in this embodiment, a plurality of depressions 116, a space 117, a rear cutout 118 and a bottom cutout 119. The plurality of depressions 116 is defined in upper, lower and side surfaces of each side portion 114. The space 117 is defined in the rear of the first housing member 11, and the rear cutout 118 and the bottom cutout 119 are provided with the rear cutout 118 in communication with the space 117.

Figure 7:
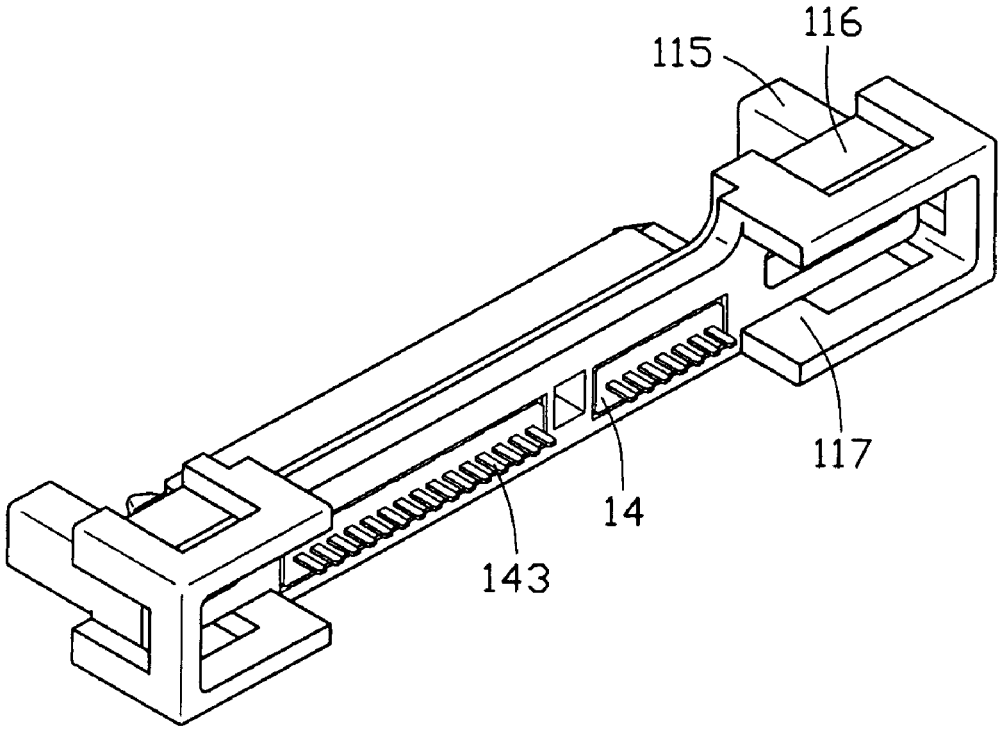
FIG. 7 is a view similar to FIG. 6, but with terminal modules assembled thereto.

In assembly, the terminal modules 14 are first inserted into the rear of the first housing member 11 with contact portions 142 of the first and second sets of terminals 140, 141 received in corresponding first and second passageways 110, 111 and with tail portions 143 of the terminals 140, 141 rearwardly projecting into the space 117 of the first housing member 11 (see FIG. 7). Front ends of the contact portions 142 of the terminals 140, 141 are curved and project downwardly into a corresponding first or second L-shaped slot 130, 131 communicating with the plurality of first or second passageways 110, 111. The rearwardly projecting tail portions 143 of the terminals 140, 141 are then terminated to corresponding conductors 20 of the cable 2 by conventional means such as by soldering. The first housing member 11 together with the assembled terminal modules 14 and the cable 2 is then conveyed into a mold. An electrically insulating resin material such as PVC (polyvinyl chloride) is injected into the mold to fill the depressions 116, the space 117, the rear cutout 118 and the bottom cutout 119 of the first housing member 11. The resin material lies around the first housing member 11 and the connection of the tail portions 143 of the terminals 140, 141 and the conductors 20 of the cable 2, as well as lying around insulators 21 of the cable 2 to form a strain relief 120 for resisting traction forces applied on the cable 2. The second housing member 12 is thus resulted, which comprises, except for the strain relief 120, a body 121, a plurality of protrusions 122, a strip 123 and a tongue 124 respectively corresponding to the space 117, the depressions 116, the rear cutout 118 and the bottom cutout 119 of the first housing member 11. Although the second housing member 12 is shown in FIG. 1 as a component separate from the first housing member 11, it should be understood that this is only for clarifying purposes. The mold is finally removed, and the Serial ATA cable receptacle connector 1 of the shape illustrated in FIGS. 2 and 3 results.

In this embodiment, the first and second housing members 11, 12 are preferably made of different thermoplastic resin materials. However, the materials of the first and second housing members 11, 12 are not necessary restricted to resin but may be formed of any electrically insulating materials having enough rigidity. It should be noted that the first housing member 11 should be made of an electrically insulating material being capable of withstanding the temperature of molding the second housing member 12.

Thus, the present invention provides a Serial ATA connector 1 having an insulative housing 10 composed of first and second housing members 11, 12 molded together to increase the strength thereof. When connecting/disconnecting the connector 1 with/from the device plug connector 4, the reinforcing posts 115 first mate with and last break from corresponding holes 41 of the device plug connector 4. For the reasons stated above, the forces otherwise concentrated on opposite slot walls 132 of the cable receptacle connector 1 and blades 42, 43 of the device plug connector 4 are shared and thus significantly reduced to resist breakage thereof. The Serial ATA cable receptacle connector 1 of the present invention is thus significantly reinforced to withstand in excess of 22 pounds without damage.

Although a Serial ATA cable receptacle connector is specifically applied to illustrate the invention, it should be understood that the present invention is not so limited. Other types of electrical connectors that incorporating the housing strengthening feature as disclosed are also within the scope of the present invention. Also, the first and second housing members 11, 12 may be configured as an integral member by other means, other than by molding.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector comprising:

an insulative housing consisting of a first housing member defining a plurality of depressed molding areas and a second housing member being formed by injecting molding materials into the depressed molding areas, the first housing member having a plurality of passageways and a pair of mating posts, on respective opposite sides of the plurality of passageways, adapted for insertion into corresponding receiving channels of a complementary plug connector, the first housing member further having a pair of reinforcing posts extending in the same direction as the mating posts and extending a further distance than the mating posts, the reinforcing posts being adapted for insertion into corresponding receiving holes of an insulative housing of the complementary plug connector; and a plurality of terminals having contact portions received in the first housing member and integral tail portions embedded in the second housing member wherein the depressed molded areas include central cutouts and depressions on the first housing.

2. The electrical connector as described in claim 1, wherein the first and second housing members are made of different electrically insulating materials.

3. The electrical connector as described in claim 1, wherein the reinforcing posts are of the same size.

4. The electrical connector as described in claim 1, wherein the terminals comprise a first set of power/ground terminals and a second set of signal/ground terminals electrically insulated from each other.

5. An electrical cable connector assembly comprising:

a receptacle connector comprising an insulative housing and a plurality of terminals received in the insulative housing, the insulative housing consisting of a first housing member defining a plurality of depressed molding areas and a second housing member being formed by injecting different molding materials into the depressed molding areas and structurally interlocked with the first housing member, the second housing member cooperating with the first housing member to correspondingly form and share a smooth coplanar exterior surface on each corresponding side of the combined first and second housing member, the first housing member having a plurality of passageways defined therethrough and a pair of side posts spaced from the passageways, the terminals including contact portions received in corresponding passageways of the first housing member and tail portions embedded in the second housing member;

a plug connector; and a cable having conductors terminated to corresponding tail portions of the terminals of the receptacle connector and corresponding terminals of the plug connectors at opposite ends thereof wherein the depressed molded areas include central cutouts and depressions on the first housing.

6. The electrical cable connector assembly as described in claim 5, wherein the terminals of the receptacle connector include a first set of power/ground terminals and a second set of signal/ground terminals electrically insulated from each other.

7. The electrical cable connector assembly as described in claim 5, wherein the receptacle connector, the plug connector and the cable are constructed according to the Serial ATA standard.

8. A combination comprising:

a receptacle connector comprising an insulative housing defining a receiving slot and a plurality of passageways in communication with the receiving slot and a plurality of terminals received in corresponding passageways, the insulative housing including a first housing member and a second housing member molded together, the first housing member providing a pair of side posts spaced from the passageways, the second housing member being formed by injecting molding materials into depressed molding areas defined in the first housing member and structurally interlocked with the first housing member, the second housing member cooperating with the first housing member to correspondingly form and share a smooth coplanar exterior surface on each corresponding side of the combined first and second housing member; and a plug connector comprising an insulative housing and a plurality of terminals received in the insulative housing, the insulative having a blade portion for being received in the receiving slot of the receptacle connector and a pair of receiving holes distant from the blade portion for receiving the side posts of the receptacle connector therein wherein the depressed molded areas include central cutouts and depressions on the first housing.

9. The combination as described in claim 8, wherein the insulative housing of the receptacle connector further comprises a pair of mating posts on opposite sides of the passageways, and the insulative housing of the plug connector further defines a pair of receiving channels on opposite sides of the blade portion for receiving the mating posts.

10. The combination as described in claim 9, wherein the side posts of the receptacle connector extending in the same direction as the mating posts and extend a further distance than the mating posts.

* * * * *